US006151735A

United States Patent [19]

Koby et al.

[11] Patent Number: 6,151,735

[45] Date of Patent: Nov. 28, 2000

[54] ZONE INFLATABLE ORTHOPEDIC PILLOW

[75] Inventors: Aurelia Koby; Ian MacMorran, both of San Diego, Calif.

[73] Assignee: IMAK Corporation, San Diego, Calif.

[21] Appl. No.: 09/248,556

[22] Filed: Feb. 11, 1999

Related U.S. Application Data

[60] Provisional application No. 60/084,338, May 5, 1998.

[51] Int. Cl.[7] ..... A47G 9/00

[52] U.S. Cl. ..... 5/644; 5/708

[58] Field of Search ..... 5/644, 708, 710, 5/713

[56] References Cited

U.S. PATENT DOCUMENTS

| | | | |
|---|---|---|---|
| D. 194,659 | 2/1963 | Embry | 5/644 |
| 795,108 | 7/1905 | Doellinger | 5/644 |
| 918,391 | 4/1909 | Taarud | 5/644 |
| 2,896,227 | 7/1959 | Reed | 5/644 |
| 3,042,941 | 7/1962 | Marcus | 5/708 |
| 3,133,696 | 5/1964 | Mirando | 5/708 |
| 3,155,991 | 11/1964 | Dunham | 5/708 |
| 3,583,008 | 6/1971 | Edwards | 5/708 |
| 3,842,453 | 10/1974 | Redfield | 5/491 |
| 4,724,560 | 2/1988 | Christie | 5/644 |
| 5,068,933 | 12/1991 | Sexton | 5/644 |
| 5,243,722 | 9/1993 | Gusakov | 5/644 |
| 5,708,999 | 1/1998 | Priolo et al. | 5/644 |
| 5,771,514 | 6/1998 | Wilhoit | 5/644 |
| 5,824,013 | 10/1998 | Allen | 5/643 |
| 5,829,079 | 11/1998 | Castro | 5/644 |
| 5,898,963 | 5/1999 | Larson | 5/644 |

FOREIGN PATENT DOCUMENTS

| | | | |
|---|---|---|---|
| 2648999 | 1/1991 | France | 5/644 |

*Primary Examiner*—Alexander Grosz
*Attorney, Agent, or Firm*—J. F. McLellan

[57] ABSTRACT

A fully portable pillow-like device is provided, shaped for comfortable restrain of head movement, and including a sectioned inflatable bladder for shaping the support to conform to any particular user's requirements. The bladder is constructed in 3 independent zones, each separately inflatable to differing degrees of internal pressure and firmness. Inflation means is provided for each of the inflatable bladder zones, and in the preferred embodiment, the inflation means consists of independent pumps, one for each zone, which are fully contained within the perimeter of the bladder form. The pump means consists of a chamber enclosing a resilient volume of open cell foam rubber or other sponge-like material, which when pressed will draw air from an inlet valve and expel it via an outlet check valve into a connected inflatable chamber. A relief valve is also provided at each pump in order that the gas pressure in the inflatable chamber may be adjusted to the user's preference.

10 Claims, 3 Drawing Sheets

ZONE INFLATABLE ORTHOPEDIC PILLOW

This application is a continuation of Ser. No. 60/084,338 (PPA) filed on May 5, 1998.

BACKGROUND OF THE INVENTION

Proper support of the neck and head in a reclining position while resting or sleeping is a critical function in persons of both normal cervical alignment and those whose alignment or musculature of the upper back and neck has been traumatized. While pillows of various shapes and specialized configurations offer some support, the firm stabilization and restraint that is often therapeutically necessary has been missing in available devices. While restraints such as collars are also available for stabilization, the comfort that will encourage frequent and regular use of the appliance is missing in these. In particular, a device has long been needed that will stabilize the neck, gently restrain the head from movement and provide the comfort that will encourage regular beneficial use.

1. Field of the Invention

The field of this invention are head support pillow and cervical neck restraints, and integrated inflation means therefor.

2. Description of the Related Art

Many types of head restraints in the form of cervical collars have long existed, and new types of resting support devices, generally variations on the standard form and filling of a pillow, have come to market in recent years. Further, relatively complex devices for precise immobilization of head, neck and shoulder areas have emerged from the medical device filed. Finally, hybrid devices that use the familiar forms of pillow or collar and combine certain features of more complex medical appliances have emerged for self-therapy. The device of this application is in this last category.

There is a need for improved forms of supporting head restraints in the sleeping environment. Sound sleep depends on the absence of discomforting obstructions to head and neck positioning, and regular pillow forms of support cannot adjust to the many and extreme variations of user physiology and preferences, much less the more extreme requirements of therapy in cases of trauma or deterioration of the cervical area. The slight but significant adjustments that are sought are typified by the pounding and re-shaping of a pillow to get it into an exactly right shape, only to have it collapse and be pounded again into the night. Something more effectively and reliably adjustable is needed.

BRIEF SUMMARY OF THE INVENTION

A fully portable pillow-like device is provided, shaped for comfortable restraint of head movement, and including a sectioned inflatable bladder for shaping the support to conform to any particular user's requirements to optimize comfort and stabilize support and restraint of movement. The system as presented provides mild traction and restraint for a user's head, neck and shoulder regions, and is made fully adjustable to variations in the user's particular anatomy and preferences. Specifically, the inflatable bladder is constructed in multiple independent parts or zones, each separately inflatable to differing degrees of internal pressure and firmness. Inflation means is provided for each of the inflatable bladder zones, and in the preferred embodiment, the inflation means consists of independent pumps, one for each zone, which are fully contained within the perimeter of the bladder form. Further in the preferred embodiment, the pump means consists of a chamber enclosing a resilient volume of open cell foam rubber or other sponge-like material, which when pressed will draw air from an inlet valve and expel it via an outlet check valve into a connected inflatable chamber. A relief valve is also provided at each pump in order that the gas pressure in the inflatable chamber may be adjusted to the user's preference. The entire bladder system is surrounded by a cover which may include cushioning layers of foam, feather or fiber filling, as well as constituting a slip cover for containment and tactile comfort.

DETAILED DESCRIPTION OF THE PREFERRED EMBODIMENT

Figure 1:
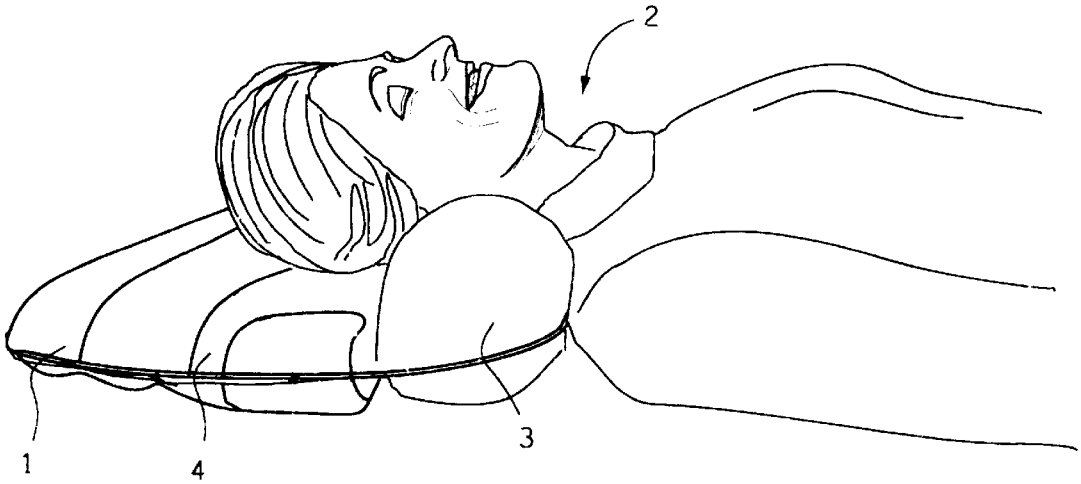
FIG. 1 is a perspective view of the inflatable pillow bladder component showing a user in resting position.

Referring to FIG. 1, the inflatable pillow bladder component 1 (shown for clarity without the cover padding components that would normally surround the bladder) is shown supporting the head of the user 2 in a resting position. As will be shown later, the inflatable bladder system is comprised of separately inflatable chambers each with associated inflation and deflation means. Two of those chambers, the neck support chamber 3 and head support chamber 4, are visible in this view. The neck support chamber 3 is inflated to a shape that will cradle the user's neck, gently restrain movement from side to side and provide a firm but gentle variable upward traction by urging the user's head upward and extending the neck. The user's shoulders lie forward of the entire pillow construction and the traction force is effectively applied to extend the neck upwardly from the shoulders. Such controlled traction force is beneficial not only in therapeutic application to a traumatic condition, but is also healthfully stimulating to the normal musculature and upper skeletal structure. However in order to be maximally effective and comfortable, the shape of the pillow and thus the specific traction force applied to the user must be varied in sometimes minute degrees according to the user's requirements and personal preferences, which may also change over time and require further adjustment. No standard fixed shape pillow can accommodate either these variable requirements or indeed the wide variation in human physiognomy among the population of users. The within invention has been conceived to enable fine adjustments to the supporting gas pressure in each separate chamber, customizing the exact shape of the inflatable pillow and traction force to any particular user.

Figure 2:
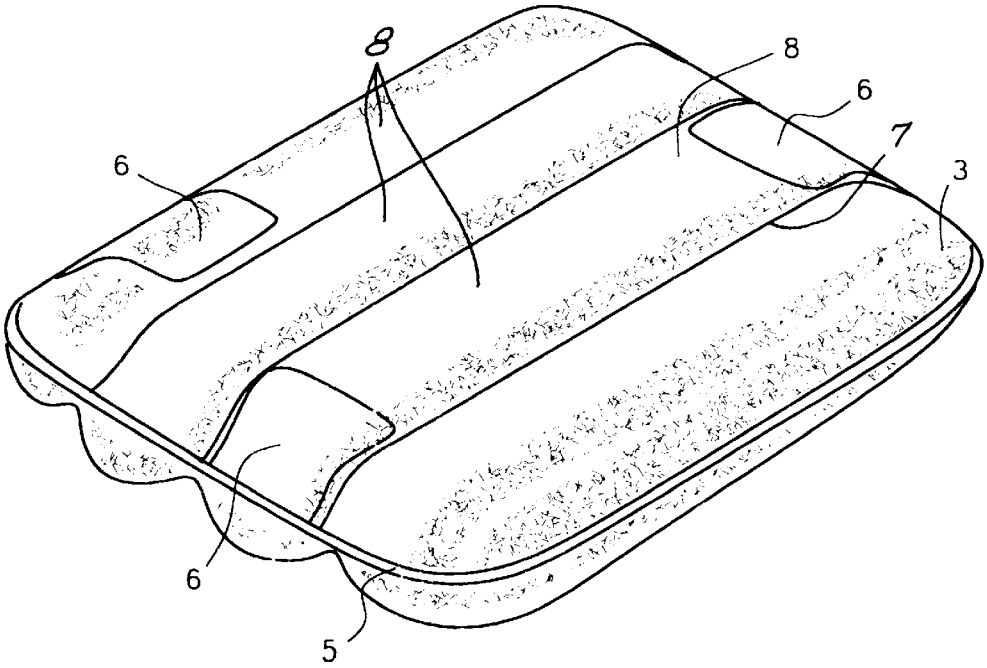
FIG. 2 is a perspective view of the of the pillow with the exterior cover in place.

FIG. 2 is a perspective view of the inflatable pillow with its cover 5 in place. The cover surrounds the inflatable bladder and is typically composed of a fabric quilted surface for tactile comfort of the user. Further it may be seen in this view that it is advantageous to configure the fabric cover with stitched zones that help the user define the function of the device, including a stitched fabric zone 7 that indicates the neck support region under which is found the neck support chamber 3 as shown in FIG. 1. The other three transverse bands 8 of the stitched cover indicate the head support zone under which is the head support chamber 4 as shown in FIG. 1. The remaining stitched zone areas 6 indicate the location of the 3 pump chambers that will be described later, and which are used to make the adjustments in inflation pressure that define the shapes of the inflatable chambers and thus the function of the inflatable pillow.

Figure 3:
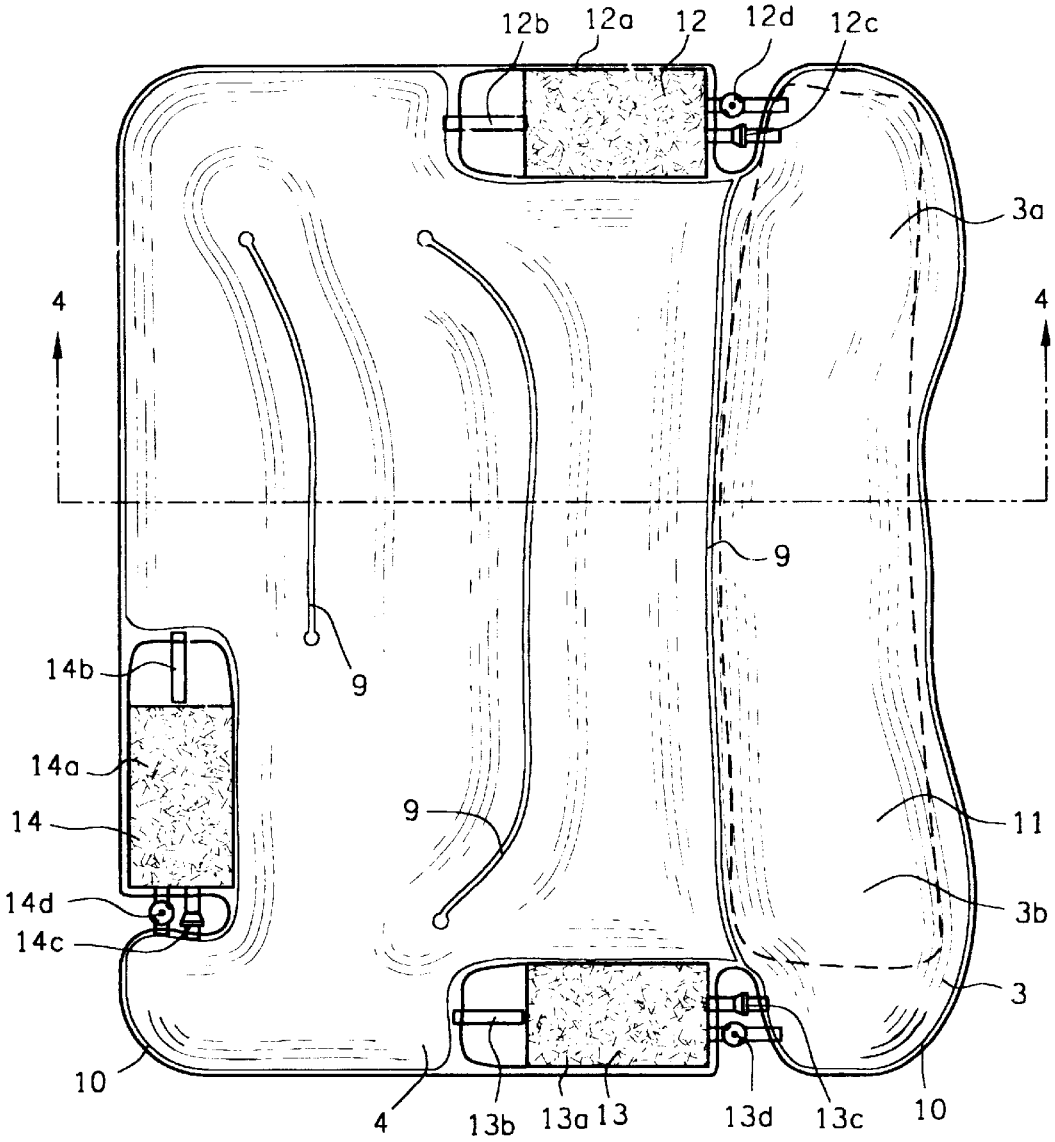
FIG. 3 is a top view of the inflatable pillow bladder component showing the 3 chambers and 3 pumps.

FIG. 3 is a top view of the inflatable pillow bladder component showing the 3 chambers and 3 pumps. The bladder is typically composed of upper and lower layers of flexible vinyl sheet material that may be conveniently thermo-formed and sealed to the desired shape by pressing interior chamber-defining thermo formed seams 9 to bond the layers, and edge seams 10 to enclose the entire two layers to form the inflatable pillow device. Further, two separate chambers are seen in this view to be defined by the thermo-formed seams, the neck support chamber 3 shown as an oval-form closed tube shape, and the head support chamber 4, which is seamed to form a serpentine chamber in three tubular regions.

Also shown in FIG. 3 in hidden line within the neck support chamber 3 is a separately inflatable inner neck traction chamber 11. Now that the three discrete chambers have been defined, the inflation function of each chamber may be seen to be performed by three separate pumps, one associated with each separate chamber of the pillow, and each of the three pumps contained within the perimeter of the pillow form in a pump chamber formed by thermo-seaming in the same manner as the main inflation chambers. Pump chamber 13 thus is comprised of yet another seamed region of the upper and lower vinyl sheets, and contains a resilient sponge-like pumping means 13*a*, an air inlet flutter valve 13*b*, an inflation check valve 13*c*, and an exhaust relief valve 13*d*, both 13*c* and 13*d* operatively connected to the neck support chamber 3.

Similarly, the head support pump chamber 14 is operatively connected to the head support inflation chamber and includes a resilient pump member 14*a*, an inlet valve 14*b*, an inflation check valve 14*c* and a relief valve 14*d*. In the same manner, the inner neck chamber is associated with inner chamber pump chamber 12, pump 12*a*, inlet valve 12*b*, check valve 12*c* and relief valve 14*d*. Note that although the valve mechanisms are illustrated as separate parts, the inflation and deflation functions can also be combined in a unitary valve mechanism. The function of the resilient chamber-contained pumps are described later; at this point note that the three separate inflation chambers, each with an associated pump inflation means are fully described and shown to be all contained within the perimeter of the pillow form.

Note also in FIG. 3 that the forward neck support chamber 3 is shown to include left support zone 3*a* and right support zone 3*b*. These two support zones are formed as rounded vertical extensions on either side of the users head and neck that will cradle the user and provide moderate restraint of side-to-side head movement. As the chamber 3 is inflated to higher pressures, the support zones 3*a* and 3*b* will, of course, become firmer and more pronounced vertically, and conversely as pressure in chamber 3 is decreased, the side support regions will become increasingly slack and provide less restraint.

Figure 4:
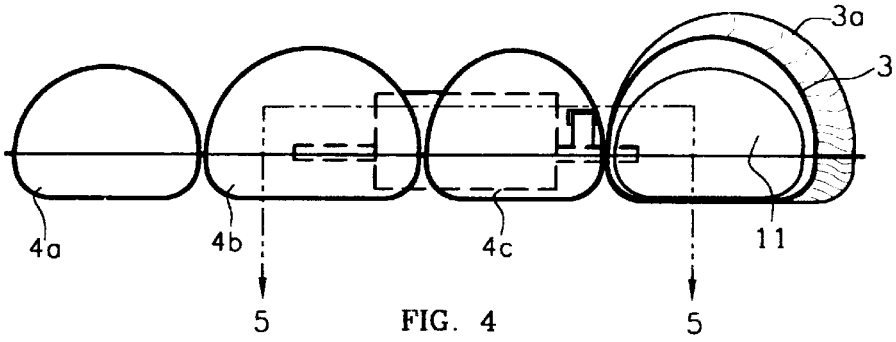
FIG. 4 is a cross section along line 4—4 of FIG. 3.

FIG. 4 is a cross section along line 4—4 of FIG. 3 and shows that the head support chamber is presented to the user as 3 tubular forms, rounded at the upper surface by thermo-forming to shape, and flattened at the bottom as the bottom surface is formed from a flat sheet without thermo-form shaping. The exact shape of the forms of the head support chamber in use will be defined by the inflation pressure applied by pump 14*a* and the position and weight of the user's head. The user may adjust the supporting shape of this chamber by pressing the pump 14*a* for small increments of increased inflation pressure or by deflating the chamber in increments by depressing the associated relief valve. In the same way the user can adjust the shape of the separate inner neck traction chamber 11 with its associated pump and relief valve to provide the comfort or required traction sought by raising the volume of the neck support chamber which will tilt the head back and extend the neck. Finally, the user may also adjust the shape and supporting force of the neck support chamber 3 which is seen to surround inner neck traction chamber 11. This dual support at the user's neck allows for a firm neck support from the inner chamber inflated to a higher pressure and a variably softer or harder support and restraint from the outer chamber inflated at a lower pressure. In practice this may mean that the support to the neck is firm at the center of the pillow where the weight of the user's neck and head may compress the outer chamber and contact the firm inner chamber, and be comparatively softer at the distal regions of the outer chamber as the user's weight urges the air away from the center and into the vertical extension of the side support regions 3*a* and 3*b*.

Figure 5:
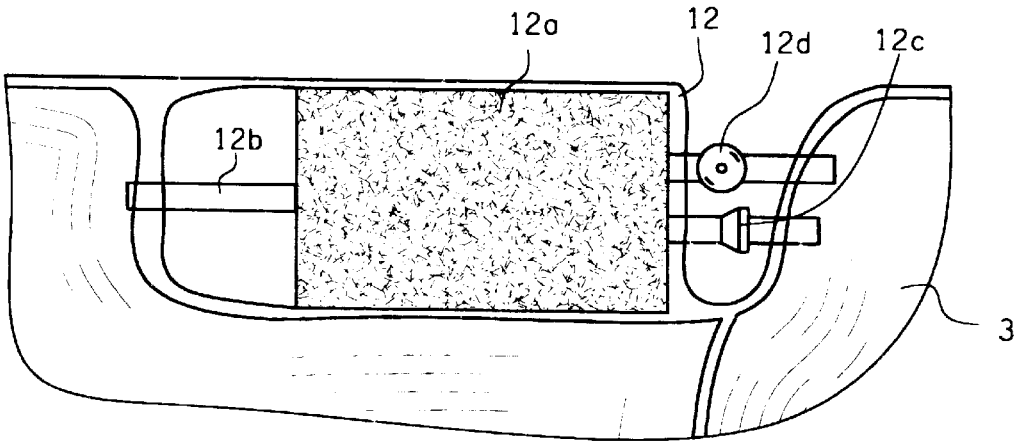
FIG. 5 is a partial side view section along line 5—5 of FIG. 4, showing detail of the pump.

FIG. 5 is a partial side view section along line 5—5 of FIG. 4, showing detail of the pump mechanism. The pump chamber 12 is formed as an enclosure by thermo-forming the seams that define the chamber within the same upper and lower vinyl pressed sheet material that forms the entire inflatable pillow. A block of resilient open-cell foam-rubber-type material (colloquially, and referred to for convenience here as, a sponge) 12*a* is contained within the chamber, which provides the spring pumping function as it is compressed and expels air from within the cells of the sponge, and springs back when released. In this manner, the user may apply small volumes of inflation air to the associated inflation chamber 3 via the one way check valve 12*c*. Air is drawn into the sponge pump via a one-way flutter valve tube 12*b* when the sponge is released and expands. The air pressure thus applied via check valve 12*c* is trapped and maintained in the inflation chamber 3 unless and until it is relieved by pressing the relief exhaust valve 12*d*, either to deflate the chamber in small increments or to fully deflate it. Since the major component of the sponge pump is a relatively soft resilient material, the pump does not present an irritating hard surface to contact the user, but actually forms a part of the gently supporting structure of the inflatable pillow.

By viewing the depictions of the sponge pump construction in FIGS. 5 and 3, it may be seen that the sponge pumps are completely contained within the overall volume formed by the inflatable pillow in the same shape as a traditional pillow—a resilient rectangular three dimensional rounded form. When the quilted or padded cover is applied, the invention closely resembles a traditional pillow in spite of the major functional improvements embodied. It has been found that the familiar is reassuring, that ease of use encourages use, that gentleness of restraint and support is far more effective than uncomfortable hard restraining devices that will discourage their use by their own discomfort and difficulty.

Figure 6:
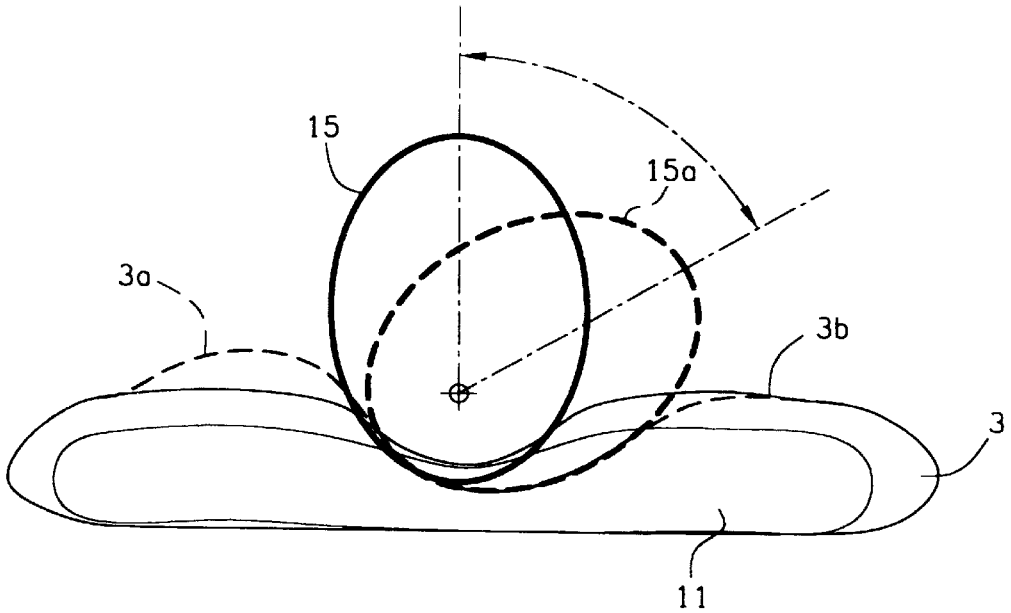
FIG. 6 is a view of the front bladder tube showing the user's head in two positions.

FIG. 6 is a view of the front bladder tube showing the user's head in two positions. The inner neck support tube 11 provides the primary tractioning support to the user's neck when the head is in neutral position 15, and the outer neck support chamber tube 3 provides secondary neck support at the center plus symmetrical side support and restraint as left region 3*a* and right region 3*b* are vertically extended at each side of the head. While the user may roll his head to the side, a gentle restraining force of the regions 3*a* and 3*b* urge the head to return to the center position without the cumbersome restraint of older devices such as an uncomfortably restrictive cervical collar. In fact, if the user experiences greater comfort by shifting his head to a side position 15*a*, he may do so by overcoming the mild restraining pressure of support region 3*b*, and the pressure of doing so will flatten region 3*b* and move interior air volume to the other side to stabilize the new positioning.

Thus it may be seen that the construction of the within invention effectively provides adjustability in three separate regions that support and restrain the head and neck of the reclining user. The sponge pump mechanisms are easily activated to control the three inflation chambers independently, and the advantageous simplicity of the sponge pump can be manipulated easily even through a padded cover. Any of the chambers can be adjusted repeatedly until the user's comfort is optimized.

What is claimed is:

1. An inflatable pillow for supporting a user's head and neck comprising:

a bladder formed of upper and lower layers of sheet material and a perimeter seam;

at least two separate independent inflation chambers formed within the bladder by interior seams and comprising a forward chamber and a rearward chamber, the placement of the forward chamber being under the user's neck when the user's head is placed on the rearward chamber;

a third independent chamber contained within the forward chamber such that higher inflation pressure may be contained within the third chamber than in the forward chamber; and discrete inflation pump means associated with each of the independent chambers, each of the pumps being contained within the volumetric form of the pillow when inflated.

2. An inflatable pillow for supporting a user's neck comprising:

a bladder including an independently inflatable outer neck chamber adapted to extend laterally beneath the neck for supporting the neck, and terminating in oppositely located end portions, the bladder further including an independently inflatable inner neck support having a predetermined firmness located within the outer chamber and adapted to underlie the neck; and inflation means operative to inflate the outer neck chamber to a firmness less than the predetermined firmness, the outer neck chamber providing fluid communication between the oppositely located end portions of the outer neck chamber thereby enabling air flow between the end portions when the head of a user is turned and the position of the neck relative to the outer neck chamber is shifted, whereby the firmness of the respective end portions is automatically adjusted to stabilize the neck comfortably in its shifted position.

3. An inflatable pillow according to claim 2 wherein the pillow is further adapted for supporting a user's head, and the bladder includes an independently inflatable head chamber adapted to underlie the user's head, the pillow further comprising separate pumps for the inner neck chamber, the outer neck chamber and the head chamber, respectively.

4. An inflatable pillow according to claim 3 wherein the pump means comprises separate pumps for the inner neck chamber, outer neck chamber, and head chamber, respectively.

5. An inflatable pillow according to claim 4 wherein each of the pumps includes a resilient foam portion, an air intake valve opening to atmosphere, and a one-way inflation valve in fluid communication with a respective one of the pumps.

6. An inflatable pillow according to claim 5 wherein each of the pumps includes a relief valve in fluid communication with a respective one of the pumps.

7. An inflatable pillow according to claim 4 wherein the outer margins of the bladder define a perimeter, and wherein all of the pumps lie within the perimeter, and including a close fitting cover covering all of the pumps and having indicia indicating the location of each of the pumps.

8. An inflatable pillow according to claim 2 wherein the inner neck support comprises an inner neck chamber independently inflatable to the predetermined firmness.

9. An inflatable pillow according to claim 8 and including pump means for inflating the outer and inner neck chambers.

10. An inflatable pillow for supporting a user's head and neck comprising:

a bladder including an independently inflatable outer neck chamber adapted to extend laterally beneath the neck for supporting the neck, and terminating in oppositely located end portions, the bladder further including an independently inflatable inner neck chamber located within the outer chamber and adapted to underlie the neck, and an independently inflatable head chamber adapted to underlie the user's head; and inflation means comprising separate pumps each having a foam body, and operative, respectively, to inflate the respective head chamber to support the user's head, operative to inflate the inner neck chamber to a predetermined firmness, and further operative to inflate the outer neck chamber to a firmness less than the predetermined firmness, the outer neck chamber providing fluid communication between the oppositely located end portions of the outer neck chamber thereby enabling air flow between the end portions when the head is turned and the position of the neck relative to the outer neck chamber is shifted, whereby the firmness of the respective end portions is automatically adjusted to stabilize the neck comfortably in its shifted position, the compressibility of the foam bodies of the pumps promoting the comfort of a user resting upon the pillow.

* * * * *

UNITED STATES PATENT AND TRADEMARK OFFICE

CERTIFICATE OF CORRECTION

PATENT NO. : 6,151,735
DATED : November 28, 2000
INVENTOR(S) : Aurelia Koby, Ian MacMorran It is certified that error appears in the above-identified patent and that said Letters Patent is hereby corrected as shown below:

Column 3,
Line 44, delete "14*d*" and insert -- 12*d* -- .

Replace claim 2 with correctly amended claim as follows:

2. An inflatable pillow for supporting a user's neck comprising:

a bladder including an independently inflatable outer neck chamber adapted to extend laterally beneath the neck for supporting the neck, and terminating in oppositely located end portions, the bladder further including an independently inflatable inner neck support located within the outer chamber and adapted to underlie the neck; and inflation means operative to inflate the outer neck chamber to a desired firmness, the outer neck chamber providing fluid communication between the oppositely located end portions of the outer neck chamber thereby enabling air flow between the end portions when the head of a user is turned and the position of the neck relative to the outer neck chamber is shifted, whereby the firmness of the respective end portions is automatically adjusted to stabilize the neck comforatably in its shifted position.

Signed and Sealed this

Twentieth Day of November, 2001

*Attest:*

Nicholas P. Godici

*Attesting Officer*

NICHOLAS P. GODICI
*Acting Director of the United States Patent and Trademark Office*